US005577307A

United States Patent [19]

Itoi

[11] Patent Number: 5,577,307

[45] Date of Patent: Nov. 26, 1996

[54] METHOD FOR PRODUCING MULTI-PLY FABRIC WITH WATER SOLUBLE THREAD

[76] Inventor: Toru Itoi, 861-11 Komatsuri-cho, Kishiwada-shi Osaka-fu 569, Japan

[21] Appl. No.: 608,933

[22] Filed: Feb. 29, 1996

Related U.S. Application Data

[63] Continuation of Ser. No. 500,312, Jul. 6, 1995, abandoned, which is a continuation of Ser. No. 264,379, Jun. 23, 1994, abandoned.

[30] Foreign Application Priority Data

Jun. 30, 1993 [JP] Japan ..... 5-186636
Feb. 14, 1994 [JP] Japan ..... 6-017052

[51] Int. Cl.[6] ..... D03D 11/00
[52] U.S. Cl. ..... 28/168
[58] Field of Search ..... 28/168

[56] References Cited

U.S. PATENT DOCUMENTS

| | | | |
|---|---|---|---|
| 2,592,153 | 4/1952 | Johnson et al. | 28/168 |
| 2,898,665 | 8/1959 | Salem et al. | 28/168 X |
| 2,989,797 | 6/1961 | Nusslein | 28/168 X |
| 3,311,928 | 4/1967 | Werth, Jr. et al. | 28/168 X |
| 3,373,471 | 4/1968 | Myers | 28/168 |
| 4,482,601 | 11/1984 | Hartigan, Jr. | 28/168 X |
| 4,527,404 | 7/1985 | Nakagaki et al. | 28/168 X |
| 4,570,311 | 2/1986 | Kawamura et al. | 28/168 X |
| 5,228,175 | 7/1993 | Olry et al. | 28/168 |

FOREIGN PATENT DOCUMENTS

| | | |
|---|---|---|
| 4222274 | 8/1992 | Japan . |

*Primary Examiner*—John J. Calvert
*Attorney, Agent, or Firm*—Kanesaka & Takeuchi

[57] ABSTRACT

A process for making a multi-ply fabric, which includes the steps of applying a water soluble material, which has no adverse effect on fabrics, around a water insoluble thread to provide a binding yarn; binding a plurality of unit fabrics one upon another with the binding yarn to provide a multi-ply fabric; putting the multi-ply fabric in water to dissolve the water soluble material thereby providing a multi-ply fabric bound with only the water insoluble thread.

4 Claims, 6 Drawing Sheets

METHOD FOR PRODUCING MULTI-PLY FABRIC WITH WATER SOLUBLE THREAD

This application is a continuation of application Ser. No. 08/500,312 filed Jul. 6, 1995, now abandoned, which is a continuation of application Ser. No. 08/264,379 filed Jun. 23, 1994, now abandoned.

BACKGROUND OF THE INVENTION

1. Field of the Invention

This invention relates to a method for producing a multi-ply fabric in which a plurality of unit fabrics are placed one upon another.

2. Description of the Prior Art

FIGS. 8 and 9 show a prior art multi-ply fabric. In these figures, the prior art multi-ply fabric 20 is produced by binding together with a binding yarn 23 two unit fabrics 21, 22 which are woven by intertwining warps and wefts alternately, and placing them one upon the other. The binding yarn 23 is a twine in which cotton fibers are twisted like a hand spun yarn. Since this multi-fabric 20 can be easily woven on a loom, it is used as a material for items such as belts, coats, jackets, slacks and bags.

For instance, to produce a belt made of the multi-ply fabric 20, the multi-ply fabric as a source material is first cut into a predetermined shape, as illustrated in FIG. 10. Then the binding yarn 23 around the rim of the cut multi-ply fabric 20 is cut with scissors or a knife, separating the rims of the unit fabrics 21, 22 from each other, as illustrated in FIG. 11. Thereafter, waste yarn generated after cutting, which is a strand that does not blend in with the unit fabrics 21, 22, is removed. As shown in FIG. 12, the rims of the unit fabrics 21, 22 are folded back toward the inside thereof and pressed with an iron to form a selvage 24. This selvage 24 formed by folding back the rims of the unit fabrics 21, 22 is stitched with a sewing thread 25.

However, since the binding yarn 23 of the prior art multi-ply fabric 20 is a twine, it is woven into the unit fabrics 21, 22 by a great tensile force during the weaving process of the multi-ply fabric 20. In the case of producing a clothing or accessory item using the multi-ply fabric 20 as a source material as described in the foregoing, it is necessary to partially separate the unit fabrics 21, 22 from each other. For instance, in the step of forming the selvage 24, the rims of the unit fabrics 21, 22 are pulled towards opposite directions to separate these unit fabrics 21, 22 from each other so that an opening is formed between them. The binding yarn 23 exposed from this opening is cut with scissors or a cutter. For this reason, the twine as the binding yarn 23 pulls each of the unit fabrics 21, 22 partially with this pulling, resulting in an uneven weave in the unit fabrics 21, 22 providing poor appearance and uncomfortable feel. Therefore, the prior art involves the problem that great skill and a lot of time and labor are required to adjust the degree of tension to be applied and the speed of a continuous pulling in cutting operation. When the binding yarn is cut with scissors or a cutter, close attention must be paid not to damage the unit fabrics 21, 22. Furthermore, it is troublesome to remove waste yarn generated after cutting. Moreover, since such removal must be done all around the rim of a product, operation efficiency is extremely low and it is not easy to implement mass-production of the product.

SUMMARY OF THE INVENTION

It is therefore an object of the present invention to provide a method for producing a multi-ply fabric comprising fabrics which can be partially separated from each other with ease.

According to a first aspect of the present invention, there is provided a method for producing a multi-ply fabric which comprises the steps of:

binding a plurality of fabrics 1, 2 together with a binding yarn 3 reinforced by intertwining a soluble thread 4 which melts or dissolves in a treatment solution that does not have an adverse effect on the fabrics, around a insoluble thread 5 (5*a*) which does not melt in the treatment solution and is not spun to form a multi-ply fabric base 6 in which the fabrics are placed one upon the other; and dipping the multi-ply fabric base into the treatment solution to melt the soluble thread of the binding yarn in the treatment solution and to remove the soluble thread from the external surface of the non-spun insoluble thread.

According to a second aspect of the present invention, there is provided a method for producing a multi-ply fabric which comprises the steps of:

binding fabrics 1, 2 with a binding yarn 3 prepared by coating the external surface of the above-mentioned insoluble thread 5*a* with a soluble material 4*g* which melts in a treatment solution which does not have an adverse effect on the fabrics to form the above-mentioned multi-ply fabric base 6, and melting the soluble material in the treatment solution to remove it from the external surface of the insoluble thread.

In the method for producing a multi-ply fabric according to the present invention, when a plurality of fabrics are bound together with the binding yarn, the binding yarn has the toughness of a twine since the soluble thread of the binding yarn is intertwined around the external surface of the unspun, insoluble thread, or the soluble material is applied to the external surface of the insoluble thread. Therefore, a loom can be used to bind the plurality of fabrics properly.

When the soluble thread is removed by the above-mentioned solution treatment, it is easy to separate the plurality of unit fabrics from each other because the plurality of fabrics are bound together with the unspun, cotton-like insoluble thread only. In addition, the multi-ply fabric retains an air layer between the unit fabrics as the binding force is not so strong, and, accordingly, has superior heat retention.

Moreover, even in the selvage forming step in the production of clothing or accessories made of multi-ply fabrics, he cotton-like insoluble thread can be easily cut with the fingers by separating the rims of the unit fabrics which have been cut into a predetermined shape.

The above and other objects, features and advantages of the present invention will become more apparent from the following description when taken, in conjunction with the accompanying drawings.

DETAILED DESCRIPTION OF THE INVENTION

A method for producing a multi-ply fabric according to the preferred embodiments of the present invention will be described hereinunder with reference to FIGS. 1 to 7.

Embodiment 1

Figure 1:
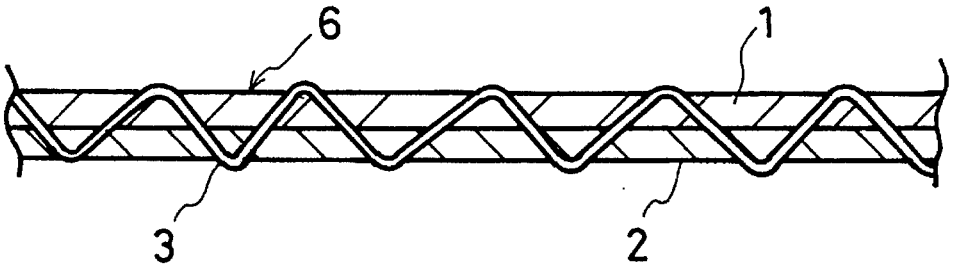
FIG. 1 is a sectional view of a multi-ply fabric base which is bound with a binding yarn according to an embodiment of the present invention.
Figure 4:
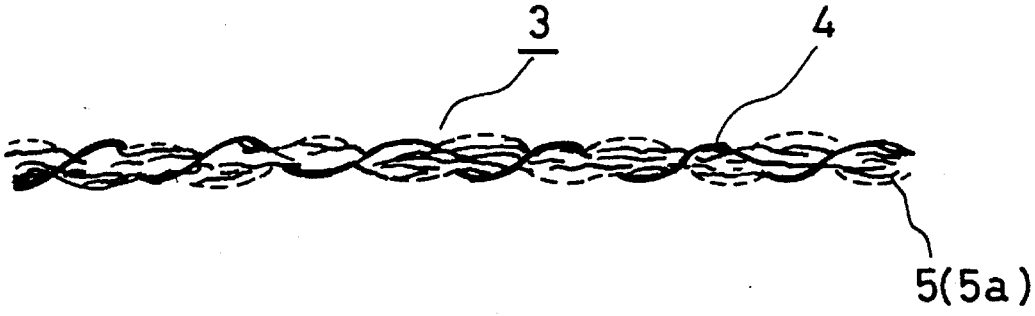
FIG. 4 is a perspective view of the binding yarn in which the twisted insoluble thread is intertwined with the soluble thread according to an of the present invention.

As shown in FIG. 1, two unit fabrics 1, 2 made of woolen fibers or fibers comprising wool and a binding yarn 3 in which a soluble thread 4 is intertwined around the external surface of an unspun insoluble thread 5 as shown in FIG. 4 are used to form a multi-ply fabric base 6 in which the two unit fabrics 1, 2 are bound together with the binding yarn 3 by a sewing machine so that they are placed one upon another.

Figure 2:
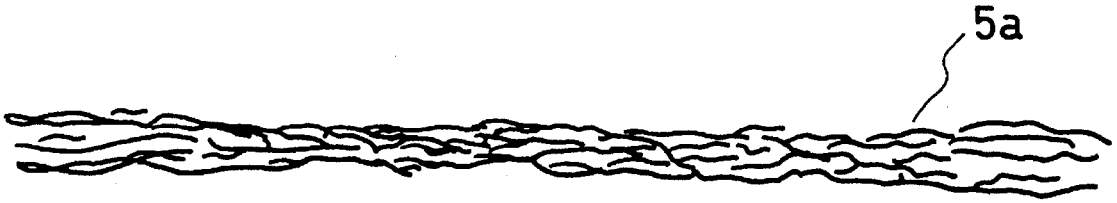
FIG. 2 is a perspective view of the insoluble thread which is not twisted.
Figure 3:
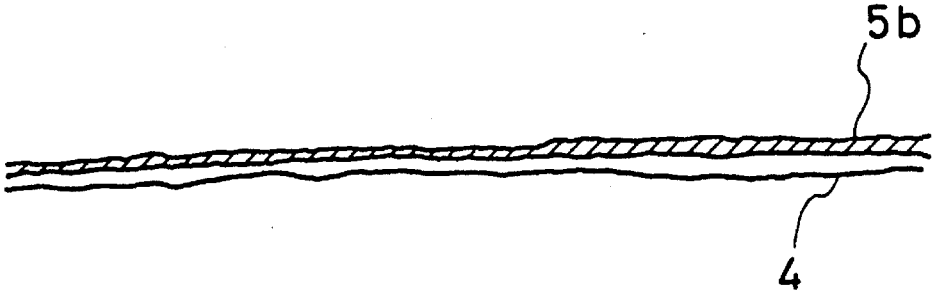
FIG. 3 is a perspective view of the soluble thread and the twisted insoluble thread.

A description is given of the above-mentioned binding yarn 3 hereinunder. To prepare the binding yarn 3 for binding the unit fabrics 1, 2 together, fifty twists in the right-hand direction per meter, for example, are first given to the insoluble thread 5*a* made of wool or cotton (cotton-like fibers before spinning) as shown in FIG. 2 and the thus twisted insoluble thread 5*a* is spun to form a spun thread 5*b* as shown in FIG. 3. Then the spun soluble thread 4 which can melt in a solution, such as water soluble vinylon, is placed in parallel to this thread 5*b*, and fifty twists in the left-hand direction are given to both the spun thread 5*b* and the soluble thread 4. The resulting binding yarn 3 retains strength as a thread as shown in FIG. 4 because the soluble thread 4 is intertwined around the external surface of the insoluble thread 5 which restores the original state of the insoluble thread 5*a* made of cotton-like fibers when fifty twists in the left-hand direction are given to the spun thread 5*b*. FIG. 4 illustrates this state.

In other words, in the binding yarn 3, the spun thread 5*b* is obtained by giving the first twists in the right-hand direction to the insoluble thread 5*a* and the second opposite-direction (left-hand-direction) twists given to both the spun thread 5*b* and the soluble thread 4 releases the intertwine of a plurality of fibers constituting the spun thread 5*b* so that the plurality of fibers are loosened and the spun thread 5*b* becomes the insoluble thread 5. That is, this insoluble thread 5 restores the original state of the insoluble thread 5*a* while it is bound with the soluble thread 4. Even if this binding yarn 3 is used to stitch the unit fabrics 1, 2 together, it retains strength as a binding yarn 3, thus making it easy to sew the unit fabrics 1, 2 with the binding yarn 3.

Figure 8:
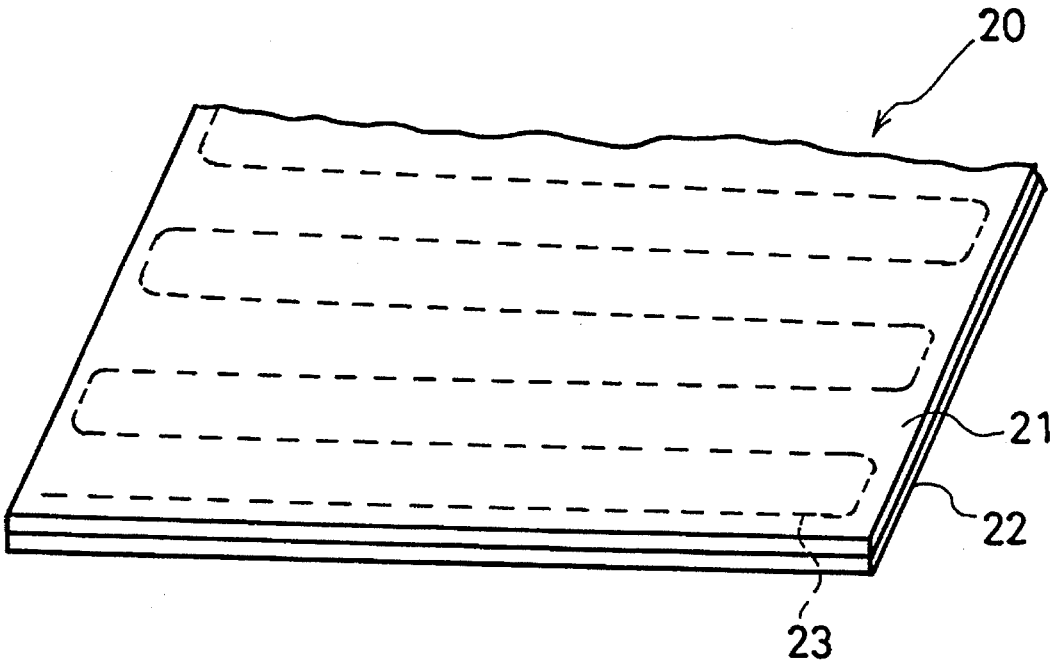
FIG.8 PRIOR ART
FIG. 8 is a perspective view of a prior art multi-ply fabric.
Figure 9:
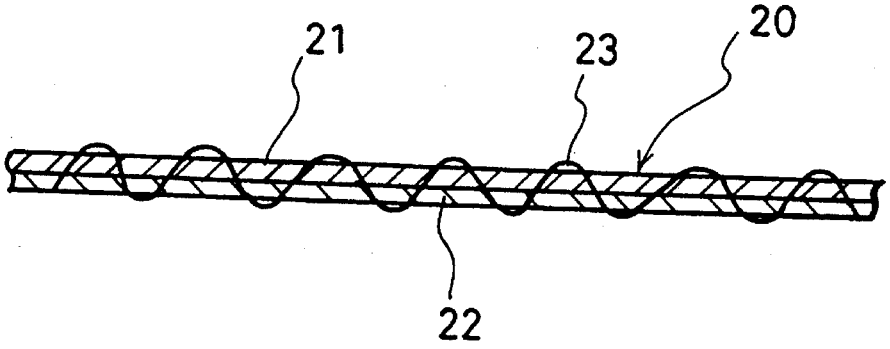
FIG. 9 PRIOR ART
FIG. 9 is a sectional view of the prior art multi-ply fabric of FIG. 8.
Figure 10:
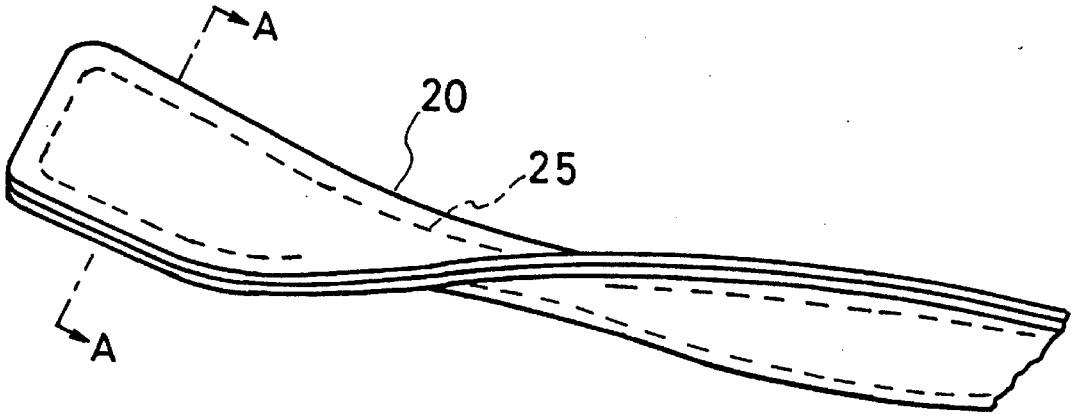
FIG. 10 PRIOR ART
FIG. 10 is a perspective view of a clothing item made of the prior art multi-ply fabric.
Figure 11:
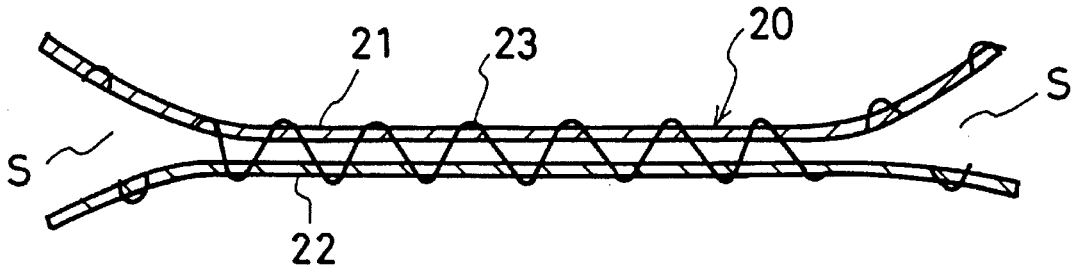
FIG. 11 PRIOR ART
FIG. 11 is a sectional view of the prior art multi-ply fabric illustrating the selvage forming process.
Figure 12:
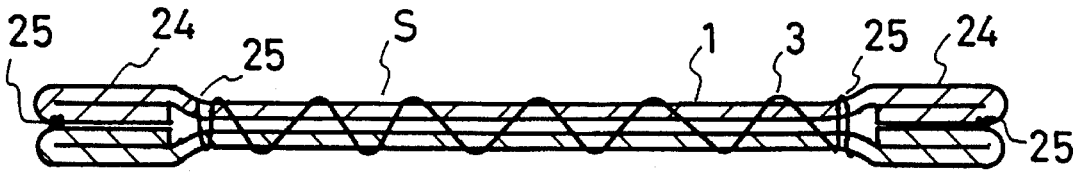
FIG.12 PRIOR ART
FIG. 12 is a sectional view of the prior art multi-ply fabric illustrating the selvage forming process.

A weft made of the binding yarn 3 with a pitch of several meters is used to stitch together the unit fabrics 1, 2 by a sewing machine in the same manner as shown in FIG. 8, and then the resulting multi-ply fabric base is dipped into a solution to melt the soluble thread 4. The unit fabrics 1, 2 are bound together only with the insoluble thread 5*a* made up of cotton-like fibers. This insoluble thread 5*a* is strong enough to bind the unit fabrics 1, 2 together but can be easily cut with the fingers by separating the unit fabrics 1, 2 from each other. Therefore, only a required portion of the unit fabrics can be separated when necessary.

Unlike an ordinary multi-ply fabric in which unit fabrics are stitched together with a spun thread, this multi-ply fabric is such that the unit fabrics 1, 2 are not bound together at a high density and there is an air layer between the unit fabrics 1, 2. Therefore, this multi-ply fabric has excellent heat retention.

Furthermore, a fabric having a lining can be obtained by using a lining fabric on an inner side thereof. In addition, a fabric providing a sense of high quality and excellent in gas permeability, heat retention and anti-humidity property can be obtained by using wool on both sides or one side thereof.

In the above-described Embodiment 1, strength is provided to the binding yarn by intertwining the soluble thread 4 to be melted later, around the external surface of the unspun (not intertwined) cotton-like insoluble thread 5*a*. In other words, the insoluble thread 5*a* alone is easily cut when it is processed by a sewing machine, but when it is reinforced by the insoluble thread 4, it can withstand processing by the sewing machine.

In Embodiment 1, twists have been given to the insoluble thread 5*a* to form the spun thread 5*b*. Such a twisted spun thread 5*b* is commercially available. When a commercially available thread is used, the insoluble thread 4 is placed along this thread 5*b* as shown in FIG. 3, and these threads are twisted in a direction opposite to the twisting direction of the thread 5*b*. In other words, when the commercially available thread 5*b* is used, the twisting step of the insoluble thread 5*a* can be omitted.

Embodiment 2

Figure 5:
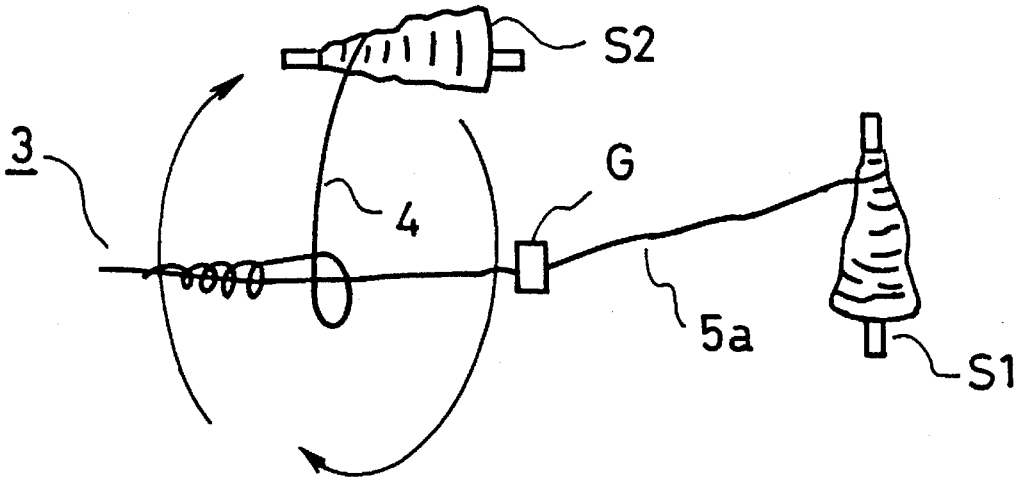
FIG. 5 is a diagram explaining the production process of the binding yarn according to the present invention.

As for a method for reinforcing the insoluble thread 5*a*, as shown in FIG. 5, the soluble thread 4 is pulled out from a spindle S2 which is rotated by rotary mechanism together with the insoluble thread 5*a* which is pulled out from a spindle S1 through a guide G so that the soluble 4 is intertwined around the external surface of the insoluble thread 5*a* to obtain the reinforced insoluble thread 5*a*.

Embodiment 3

Figure 6:
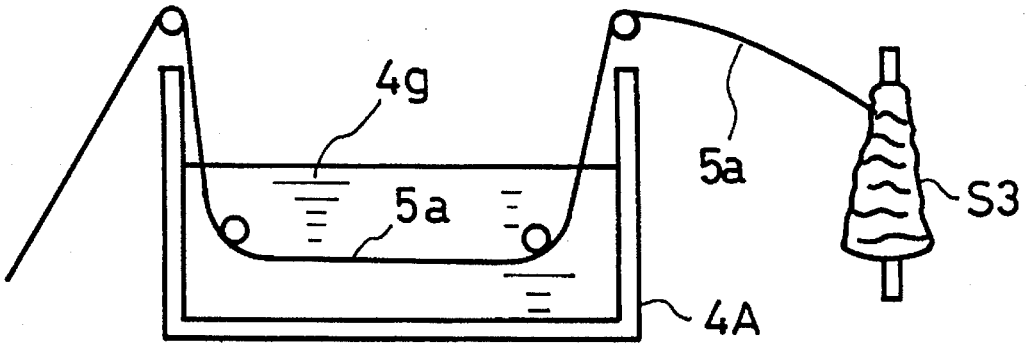
FIG. 6 is a diagram explaining the production process of the binding yarn according to another embodiment of the present invention.
Figure 7:
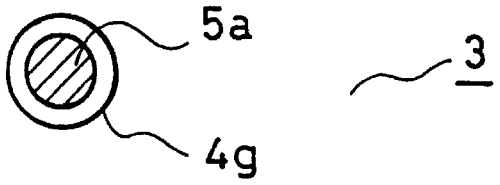
FIG. 7 is a sectional view of the binding yarn according to the present invention.

In FIG. 6, the insoluble thread 5*a* fed from a spindle S3 is dipped into a solution of a soluble material 4*g* which is melted and contained in a tank 4A, and taken from the tank to obtain the reinforced binding yarn 3 coated with the soluble material 4*g* as shown in FIG. 7. The unit fabrics are bound together with the thus obtained binding yarn 3 and then the soluble material 4*g* is melted away to obtain a multi-ply fabric bound only with the insoluble thread 5*a*.

As described on the foregoing pages, a method for producing a multi-ply fabric according to the present invention comprises the steps of: binding together a plurality of fabrics with a binding yarn obtained by intertwining the soluble thread around the external surface of the unspun cotton-like insoluble thread or a binding yarn obtained by coating the external surface of the insoluble thread with the soluble material to form a multi-ply fabric base, and dipping the resulting multi-ply fabric base into a treatment solution to melt the soluble thread or the soluble material in the binding yarn so as to remove it from the insoluble thread. Therefore, a proper sewing operation can be performed due to the toughness of the binding yarn. In addition, since the multiple fibers of the cotton-like insoluble thread which binds the multi-ply fabric are loosened and can be cut by pulling and the unit fabrics can be partially separated with ease, operation efficiency is extremely high and mass-production of products can be easily implemented. For instance, even in the selvage forming step of the production of a clothing or accessory item made of this multi-ply fabric, the insoluble thread can be easily cut by separating the rims of the unit fabrics, which have been cut into a predetermined shape, with the fingers and not using scissors or a cutter. In this case, there is no inconvenience that the insoluble thread partially pulls the fibers of the unit fabrics.

Furthermore, according to the present invention, since the cotton-like insoluble thread before spinning binds together a plurality of fabrics flexibly, a proper air-layer can be maintained between the fabrics, thereby making it possible to provide a multi-ply fabric having heat retaining and high-grade properties.

What is claimed is:

1. A method of producing a multiple ply fabric, comprising the steps of:

providing a soluble thread along an insoluble thread which has been twisted in a first direction;

twisting said soluble thread and said insoluble thread together in a second direction opposite to said first direction to provide a binding yarn in which said soluble thread is twisted around said insoluble thread which is now untwisted;

binding a plurality of unit fabrics one upon another with said binding yarn to provide a multiple ply fabric base; and dipping said multiple ply fabric base in a solution to dissolve said soluble thread thereby providing a multiple ply fabric which is bound with only said untwisted insoluble thread so that said multiple ply fabric has excellent heat retention and is easy to separate by hand.

2. A method of producing a multiple ply fabric according to claim 1, wherein said solution is water and said soluble thread is made of water-soluble vinylon.

3. A method of producing a multiple ply fabric according to claim 1, wherein said insoluble thread is made of wool or cotton.

4. A method of producing a multiple ply fabric according to claim 1, wherein said insoluble thread is made of wool or cotton.

* * * * *